US007086831B2

(12) United States Patent
Harper

(10) Patent No.: US 7,086,831 B2
(45) Date of Patent: Aug. 8, 2006

(54) VANE MOUNTING

(75) Inventor: Cedric B Harper, Derby (GB)

(73) Assignee: Rolls-Royce plc, London (GB)

( * ) Notice: Subject to any disclaimer, the term of this patent is extended or adjusted under 35 U.S.C. 154(b) by 143 days.

(21) Appl. No.: 10/810,824

(22) Filed: Mar. 29, 2004

(65) Prior Publication Data

US 2005/0129520 A1 Jun. 16, 2005

(30) Foreign Application Priority Data

Apr. 11, 2003 (GB) ..... 0308338.3

(51) Int. Cl.
*F01D 9/00* (2006.01)

(52) U.S. Cl. ..... 415/209.3; 416/205; 416/207; 416/220 R

(58) Field of Classification Search ..... 416/205, 416/207, 204 R, 214 R, 220 R, 204 A, 244 A, 416/500, 84, 86; 415/209.4, 209.3
See application file for complete search history.

(56) References Cited

U.S. PATENT DOCUMENTS 5,411,370 A 5/1995 Varsik
6,085,593 A 7/2000 Pileri
6,619,917 B1 * 9/2003 Glover et al. ..... 415/209.3

FOREIGN PATENT DOCUMENTS

EP 1067274 A 1/2001
EP 1239119 A 9/2002

* cited by examiner

*Primary Examiner*—Edward K. Look
*Assistant Examiner*—Dwayne J White
(74) *Attorney, Agent, or Firm*—W. Warren Taltavull; Manelli Denison & Selter PLLC

(57) ABSTRACT

A vane mounting arrangement 21, 31 is provided in which a vane 22, 32 is secured through a mounting end 23, 33 within an aperture 25, 35 formed in a mounting platform 24, 34. An expandable or expansive member 26, 36 is located between the mounting end 33 and the aperture 35 in order to create compressive engagement between the mounting end 33 and the aperture 25, 35 of the platform 24, 34. The member 26, 36 is hollow with a fluid within a cavity 27, 37 in order to create the desired pressurised location by selective expansion. Thus, the assembly 21, 31 through the expandable members 26, 36 achieves a seal along with vibration decoupling and appropriate presentation of the vane 22, 32 relative to the platform 24, 34.

14 Claims, 1 Drawing Sheet

VANE MOUNTING

FIELD OF THE INVENTION

The present invention relates to vane mountings and more particularly to vane mountings used in gas turbine engines as mountings for outlet guide vanes.

BACKGROUND OF THE INVENTION

A number of vanes are provided in stator assemblies within gas turbine engines in order to appropriately guide air flows through the engine. The stator vanes do not rotate but must be resiliently located to provide guiding with limited if any possibility of detachment of a vane creating damage to expensive casings and turbine blades within the engine. Normally, a number of vane elements are located between inner and outer mounting platforms to form segments that are then combined to provide a vane assembly. Generally the inner mounting platform is manufactured from cast aluminium, the vanes themselves are forged aluminium and the outer platform is a fibre reinforced material produced by compression moulding. The vanes are located within slots in the inner and outer mounting platforms.

FIG. 1 is a schematic perspective view illustrating vanes 1 located within an outer mounting platform 4 and inner mounting platform 5. As can be seen each outer mounting platform 4 is incorporated in a casing 2 through a slot 3. Thus, the vanes 1 in platforms 4 and 5 constitute a vane segment.

The vanes 1 are secured in the platforms 4, 5 at mounting ends 6. These mounting ends 6 enter a slot in the platform 4, 5 within which the mounting end 6 of each vane 1 is potted and secured using an appropriate material. This material 8 acts to provide vibration damping in addition to location and presentation of vane 1 within its vane segment. A typical material to provide vibration damping is known as Silastic J.

SUMMARY OF THE INVENTION

In accordance with the present invention there is provided a vane mounting arrangement for improved vibration damping, the arrangement comprising an aperture in a mounting platform to receive a mounting end of a vane, the arrangement including selectively expansive means between the aperture and the mounting end to provide a seal and/or association between them.

Preferably, the expansive means comprises an inflatable bladder. Typically, the bladder is inflatable by a fluid such as a gas, liquid or both. Possibly, the fluid is an electro Theological or magnetic Theological fluid which changes its viscosity when subjected to an electrical potential or magnetic field.

Normally, the expansive means acts principally between the mounting end and an opposed surface of the aperture in the mounting platform.

Typically, the expansive means also provides vibration control and/or vibration decoupling between the mounting end and the mounting platform.

Possibly, the expansive means is secured to the mounting end and/or the aperture. Possibly, the expansive means is secured by adhesive or an interference fit or keyed association.

Generally, there is longitudinally and planar engagement between the mounting end and the expansive means.

Possibly, the expansive means is an inflatable hollow member such as a sheath or boot filled with a pressurised fluid for expansion.

Typically, the vane mounting arrangement provides apertures in an inner and/or outer platform or in apertures in opposed platforms.

Also in accordance with the present invention there is provided a mounting platform including a plurality of apertures, each aperture arranged to receive in use a mounting end of a respective one of a plurality of vanes with a respective selectively expandable means provided between that aperture and the mounting end of the respective vane.

Also in accordance with the present invention there is provided an outlet guide vane assembly incorporating vane mounting arrangements as described above.

Embodiments of the present invention will now be described by way of example only and with reference to the accompanying drawings in which:

DETAILED DESCRIPTION OF THE INVENTION

Figure 2:
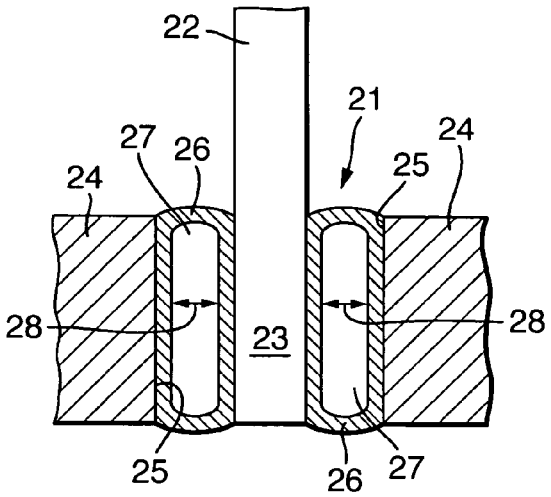
FIG. 2 is a schematic cross-section of a first embodiment of a vane mounting arrangement in accordance with the present invention.
Figure 3:
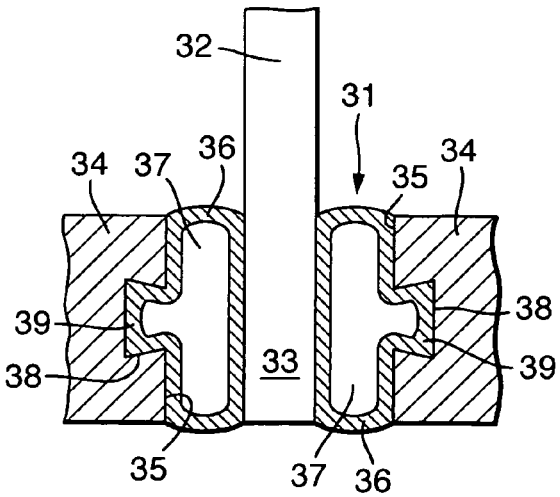
FIG. 3 is a schematic cross-section of a second embodiment of a vane mounting arrangement in accordance with the present invention.

FIGS. 2 and 3 illustrate alternative embodiments of the present invention. In accordance with the present invention an expansive member or element is used in order to provide a seal, vibration control/decoupling and assembly location of a vane mounting end within an aperture of a mounting platform. The expansive element is typically a hollow member inflatable by an appropriate fluid in order to create the seal, vibration control and fixing association.

Figure 1:
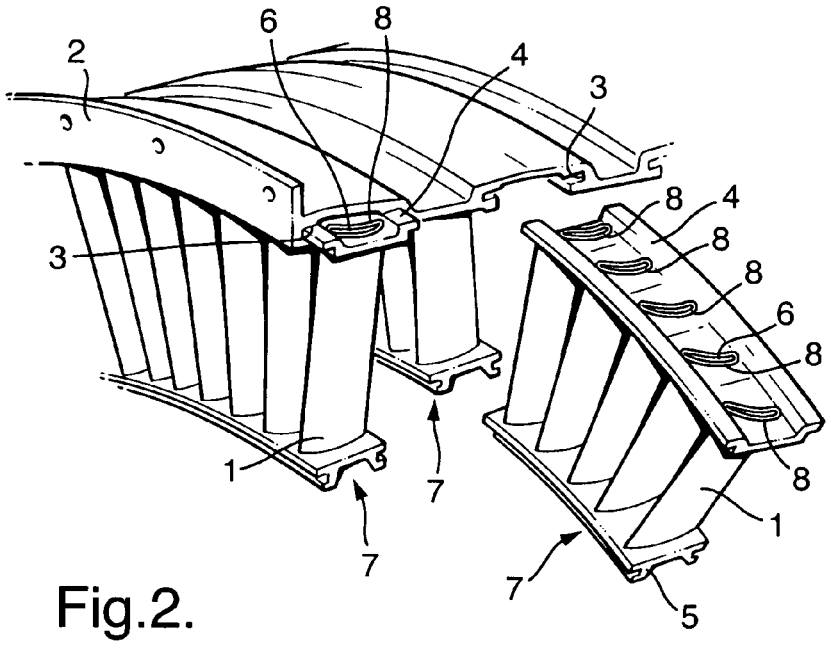
FIG. 1 is a schematic perspective view illustrating vanes located with an outer mounting platform and inner mounting platform.

FIG. 2 illustrates a first embodiment of a vane mounting arrangement 21 in accordance with the present invention. The arrangement 21 comprises a vane 22 with a mounting end 23 and a mounting platform 24 which defines an aperture 25 within which an expandable member 26 is located. In comparison with FIG. 1 the platform 24 is an inner mounting platform (5 in FIG. 1) for a vane assembly such as an outlet guide vane assembly of a gas turbine engine. However, the present invention is also applicable to outer mounting platforms. The expandable or expansive member 26 is hollow such that a cavity 27 is filled with a pressurisable fluid such as air or a liquid. Thus, the expandable or expansive member 26 acts between the mounting end 23 and the aperture 25 in order to create a seal about that end 23, provide secured location of the vane 22 and also typically provides at least some decoupling of vibration between the vane 22 and the mounting platform 24. The expandable or expansive member 26 may be associated with means to pressurise the fluid in the cavity 27 variably and selectively in order to alter the strength of positioning and seal between the mounting end 23 and the mounting platform 24. Alternatively, an expandable member 26 will be located within the aperture 25 and then the mounting end 23 forced between the sides of the member 26 in order to pressurise the fluid within the cavities 27 and therefore achieve appropriate sealing, association and vibration control. The expandable member 26 may comprise a single ring about the periphery of the aperture 25 or several expandable members or bags located within the aperture 25 in order to create an appropriate combination as an expandable member assembly within the aperture 25 to locate the mounting end 23.

In order to achieve vibration control typically the fluid within the cavity 27 must retain a degree of elasticity to absorb vibration. However, the fluid within the cavity 27 may have an electro-rheological or magnetic rheological function whereby through appropriate use of electrical or magnetic control elements associated with the platform the fluid within the cavity 27 can be rendered to have a viscosity approximating a solid for greater structural association and positioning of the vane 22 relative to the mounting platform 24 but with reduced vibration control or vice versa with lower viscosity.

As indicated above the expandable member 26 is generally hollow and inflated by a pressurised fluid in the cavity 27. In such circumstances the member 26 presses against the mounting end 23 and sides of the aperture 25 in order to form a seal, to grip the mounting end 23 and to provide vibration damping of the vane 22. Typically, the member 26 is configured with the cavity 27 and pressurised fluid such that there is substantial expansion and compression in a direction of arrowheads 28 between opposed substantially planar surfaces of the member 26 and respectively the mounting end 23 and aperture 25. Thus, there will be limited outward bulging upwards or downwards from the aperture 25.

To further improve association, opposed surfaces of the member 26 and the mounting end 23 and/or aperture 25 may be secured together through adhesive or friction association. Such fixed association between the expandable member 26 and the mounting end 23 and/or aperture 25 will prevent slippage of the member 26 within the aperture 25 and relative to the vane 22 as a result of forces presented to the vane 22 in operation, that is to say as a result of vibration due to air flows guided by the vane 22.

As indicated above the fluid within the cavity 27 will generally be specifically pressurised or the pressurisation created by forced positioning of the mounting end 23 within the member 26 will be such that appropriate sealing, association and vibration damping is achieved. In order to remove the vane 22 either the means for creating pressurisation within the cavity 27 will be removed rendering the member 26 more flaccid to enable extraction of the vane 22 or the vane 22 simply pulled in an opposite action to the forced entry approach described. It will also be understood that through temperature or electro rheological or magnetic rheological action the viscosity and pressurisation of fluid within the cavity 27 may be altered to also facilitate extraction of the vane 22.

FIG. 3 illustrates a second embodiment of the present invention. Thus, a vane mounting arrangement 31 comprises a vane 32 secured within a cavity 35 formed in a mounting platform 34. The vane 32 is secured and sealed through a mounting end 33 using an expandable member 36. The expandable member 36 essentially fills the gap between the aperture 35 and the mounting end 33.

As previously, the expandable member 36 is a hollow component with a cavity 37 normally filled with an appropriate pressurisable fluid to create abutment pressure between the mounting end 33 and surfaces of the cavity 35.

A particular feature of a second embodiment based in FIG. 3 is inclusion of a keyed association between a shaped dovetail groove 38 in the aperture 35 and a reciprocal part 39 in the expandable member 36. Thus, rather than depend upon adhesion or an interference fit as with expandable member 26 in FIG. 2, the expandable member 36 in the second embodiment depicted in FIG. 3 has a secure radial position due to the keyed association between the dovetail groove 38 and the reciprocal part 39 of the expandable member 36. Other shapes for the groove and reciprocal part could be used.

The fluid retained within the cavity 37 will be pressurised as described previously in order to create the desired seal, fixed association for the vane 32 and vibration damping as required for an effective vane mounting arrangement.

Normally the expandable member 26, 36 in accordance with the present invention will be made from an elastomeric material such as rubber and as described previously the fluid within the cavity 27, 37 will be a gas, air or a liquid appropriately chosen to achieve a good seal as well as vibration damping and reliable presentation of the vane 22, 32 from the platform 24, 34.

Of particular advantage with the present invention is the ability to vary the pressure presented through the fluid in the cavity 27, 37. By varying the degree of pressurisation of this fluid within the cavity 27, 37 the level of vibration damping can be adjusted to particular requirements. It will also be understood that the pressurisation of the fluid within the cavity 27, 37 can be increased or decreased dependent upon the necessity for appropriate presentation and sealing of the vane 22, 32. Thus residual stresses within the vane 22, 32 as a result of temperature variations causing expansion and contraction of the vane 22, 32 may be accommodated in comparison with previous substantially fixed mounting arrangements in which the mounting ends are effectively potted in a material of fixed response whereas the present members 26, 36 can vary that seal and fixing response dependent upon current requirements. Expansion and contraction of the vanes in a previous "potting" material such as Silastic J will repeatedly break the surface bond between the mounting end and the "potting" material leading to possible seal failure and degradation at least.

As indicated above it is generally the mounting of vanes into inner platforms 5 and outer platforms 2 which is of particular concern with regard to the present invention. However, it will also be understood that the vane segments 7 formed from combinations of vanes 1 and platforms 4, 5 are secured within slots 3 and that expandable members in accordance with the present invention could be secured between those platforms 4, 5 and casing slots 3 for appropriate sealing, vibration control and location.

The expandable members 26, 36 may be reinforced by embedded fibre mesh or other means particularly to prevent upward or downward bulging of the members 26, 36 and so create preferential radial expansion into sealing engagement with the mounting end 33 and platform 34 through the aperture 35.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A vane mounting arrangement comprising an aperture in a mounting platform to receive a mounting end of a vane, the arrangement including expansive means between the aperture and the mounting end to provide a seal and/or association between them wherein the expansive means comprises an inflatable bladder.

2. An arrangement as claimed in claim 1, wherein the inflatable bladder is inflatable by a fluid such as a gas, liquid or both.

3. An arrangement as claimed in claim 2, wherein the fluid is an electro rheological or magnetic rheological fluid which changes its viscosity when subjected to an electrical potential or magnetic field.

4. An arrangement as claimed in claim 1, wherein the expansive means acts principally between the mounting end and an opposed surface of the aperture in the mounting platform.

5. An arrangement as claimed in claim 1, wherein the expansive means also provides vibration control and/or vibration decoupling between the mounting end and the mounting platform.

6. An arrangement as claimed in claim 1, wherein the expansive means is secured to the mounting end and/or the aperture.

7. An arrangement as claimed in claim 1, wherein the expansive means is secured by adhesive or an interference fit or keyed association.

8. An arrangement as claimed in claim 1, wherein there is planar engagement between the mounting end and the expansive means.

9. An arrangement as claimed in claim 1, wherein the expansive means is an inflatable hollow member filled with a pressurised fluid for expansion.

10. An arrangement as claimed in claim 1 wherein the expansive means comprises several expandable members which combine about the mounting end.

11. An arrangement as claimed in claim 1 wherein the arrangement provides an aperture in an inner platform and/or an outer platform or apertures in opposed platforms.

12. A gas turbine engine including a vane mounting arrangement as claimed in claim 1.

13. A mounting platform including a plurality of apertures, each aperture arranged to receive a mounting end of a respective one of a plurality of vanes with a respective expandable means provided between that aperture and the mounting end of the respective vane wherein the expansive means comprises an inflatable bladder.

14. An outlet guide vane mounted in an arrangement as claimed in claim 1.

* * * * *